US007950242B2

(12) United States Patent
Rojas et al.

(10) Patent No.: US 7,950,242 B2
(45) Date of Patent: May 31, 2011

(54) CONTROL VALVE FOR A REFRIGERANT COMPRESSOR AND REFRIGERANT COMPRESSOR

(75) Inventors: Joan Aguilar Rojas, Leonberg (DE); Roland Caesar, Stuttgart (DE)

(73) Assignee: Daimler AG, Stuttgart (DE)

( * ) Notice: Subject to any disclaimer, the term of this patent is extended or adjusted under 35 U.S.C. 154(b) by 635 days.

(21) Appl. No.: 11/994,780

(22) PCT Filed: Jul. 5, 2006

(86) PCT No.: PCT/EP2006/006545

§ 371 (c)(1),
(2), (4) Date: Jul. 3, 2008

(87) PCT Pub. No.: WO2007/003423

PCT Pub. Date: Jan. 11, 2007

(65) Prior Publication Data

US 2008/0296524 A1 Dec. 4, 2008

(30) Foreign Application Priority Data

Jul. 6, 2005 (DE) ..... 10 2005 031 511

(51) Int. Cl.
*F25B 49/00* (2006.01)

(52) U.S. Cl. ..... 62/228.3; 251/129.15

(58) Field of Classification Search ..... 62/228.3, 62/228.1, 226, 224, 157, 126; 251/129.07, 251/129.15; 137/595; 417/222.2, 270
See application file for complete search history.

(56) References Cited

U.S. PATENT DOCUMENTS 4,475,686 A * 10/1984 Huelle et al. ..... 236/68 C
4,730,986 A 3/1988 Kayukawa et al.
4,862,700 A 9/1989 Suzuki
6,105,380 A * 8/2000 Yokomachi et al. ..... 62/228.3
6,247,899 B1 * 6/2001 Ban et al. ..... 417/16
6,250,094 B1 * 6/2001 Ban et al. ..... 62/228.3
7,077,380 B2 7/2006 Uemura et al.
2004/0136834 A1 * 7/2004 Tarutani et al. ..... 417/222.1
2004/0170504 A1 * 9/2004 Murakami et al. ..... 417/222.1
2004/0184925 A1 * 9/2004 Ochiai ..... 417/222.2

(Continued)

FOREIGN PATENT DOCUMENTS

DE 37 13 696 A1 10/1987

(Continued)

OTHER PUBLICATIONS

Abstract of JP 8-219603 A to Takano et al.*

(Continued)

*Primary Examiner* — Mohammad Ali
(74) *Attorney, Agent, or Firm* — Crowell & Moring LLP

(57) ABSTRACT

A refrigerant compressor has a control valve for controlling the degree of conveyance of the refrigerant compressor by setting a drive housing pressure $p_C$ of the refrigerant compressor. A control body controls a conveying-side control line between a discharge chamber, acted upon by high pressure of the compressor, and the drive housing of the compressor, and also controls a suction-side control line between the drive housing and a suction chamber, acted upon by suction pressure of the compressor variably in a throttling and/or shutting-off manner. The control body is driven electromagnetically. To improve the refrigerating capacity and the control behavior of the refrigerating system, the control body, which can shut off both the conveying-side and the suction-side control line, is also driven by means of a pressure cell.

12 Claims, 2 Drawing Sheets

U.S. PATENT DOCUMENTS

| | | | | |
|---|---|---|---|---|
| 2004/0191077 | A1* | 9/2004 | Ochiai | 417/222.2 |
| 2004/0228738 | A1* | 11/2004 | Hashimoto et al. | 417/222.2 |
| 2004/0253118 | A1* | 12/2004 | Inoue et al. | 417/222.1 |
| 2004/0253121 | A1* | 12/2004 | Ota et al. | 417/316 |
| 2005/0031456 | A1* | 2/2005 | Hibino et al. | 417/222.2 |
| 2005/0053474 | A1* | 3/2005 | Hirota et al. | 417/222.2 |
| 2005/0123409 | A1* | 6/2005 | Ota et al. | 417/222.2 |

FOREIGN PATENT DOCUMENTS

| | | | | |
|---|---|---|---|---|
| DE | 38 22 465 | A1 | | 1/1989 |
| DE | 10 2004 040 476 | A1 | | 3/2005 |
| EP | 0 396 017 | A2 | | 11/1990 |
| EP | 1 033 489 | A2 | | 9/2000 |
| JP | 05-099136 | A | | 4/1993 |
| JP | 8-219603 | A | * | 8/1996 |
| JP | 2000-130321 | A | | 5/2000 |
| JP | 2001-027182 | A | | 1/2001 |

OTHER PUBLICATIONS

Translaton of JP 8-219603 A to Takano et al.*

International Search Report dated Oct. 19, 2006 (PCT/ISA/210) including PCT/ISA/220, along with English translation of relevant portion (Seven (7) pages).

German Office Action dated Mar. 30, 2006 (Two (2) pages).

* cited by examiner

CONTROL VALVE FOR A REFRIGERANT COMPRESSOR AND REFRIGERANT COMPRESSOR

BACKGROUND AND SUMMARY OF THE INVENTION

This application is a national stage application of PCT International Application No. PCT/EP2006/006545, filed Jul. 5, 2006, which claims priority under 35 U.S.C. §119 to German Patent Application No. 10 2005 031 511.9, filed Jul. 6, 2005, the entire disclosure of which is herein expressly incorporated by reference.

The invention relates to a control valve for a refrigerant compressor.

A generic control valve and a generic refrigerant compressor are disclosed in German patent document DE 38 22 465 A1. The refrigerant compressor has a plurality of displacement pistons which operate in a drive housing and which are driven in their conveying movement by a swashplate driven via a driveshaft, a belt pulley and the belt drive of an engine of a motor vehicle. The pistons in this case execute an alternating stroke movement oriented in the axial direction of the associated cylinder bores. The conveying capacity of the refrigerant compressor can be set via the drive housing pressure $p_c$ which acts in the cavity of the drive housing and on the rear side facing away from the displacement side of the pistons. Thus, starting from a maximum conveying capacity of the compressor, by increasing the drive housing pressure $p_c$, the suction intake movement of the pistons can be reduced to the setting of a minimum conveying capacity or until the conveying capacity is switched off.

To set the drive housing pressure $p_C$ predetermining the conveying capacity, the drive housing of the refrigerant compressor is connected to the suction chamber having the suction pressure $p_S$ and to the conveying chamber having the conveying pressure $p_D$. In this case, usually, the drive housing pressure $p_C$ is set, when the compressor is in conveying operation, via a rigidly throttled, permanently open line to the suction chamber and via a connection, throttlable in a controlled manner by means of a valve, to the conveying chamber.

One object of the invention is to improve further the conveying capacity and the control of a refrigerant compressor.

This and other objects and advantages are achieved by the control valve and the refrigerant compressor according to the invention. A refrigerant compressor of this type or one controlled by such a valve has conveying pistons which operate in a drive housing and which execute alternating stroke movements in associated cylinder bores of the drive housing. The conveying pistons are moved between a final displacement end position concluding and limiting a displacement movement, on the one hand, and a suction intake end position concluding and limiting a suction intake movement. The displacement movement is directed toward a valve plate delimiting the cylinder bore of the drive housing, opposite the displacement side of the conveying pistons. The valve plate has two contradirectionally closing nonreturn valves, via which the cylinder bore is connected, on the one hand, to a suction chamber of the compressor and, on the other hand, to a conveying chamber of the compressor.

The conveying pistons are driven by a swashplate rotating in the drive housing and having an adjustable angle of incidence. The swashplate is in turn driven via an associated axle, a belt pulley seated on the axle and the belt drive of an engine of the motor vehicle. The drive housing of the refrigerant compressor forms, in the range of rotation of the swashplate, a hermetically sealed-off cavity which is connected to the rear side facing away from the displacement side of the conveying pistons, and in which a drive housing pressure $p_c$ acts. With the displacement end position of the pistons remaining the same, the suction intake end position of the pistons can be set by varying the angle of incidence of the swashplate, and thereby varying also the conveying capacity of the refrigerant compressor.

The angle of incidence of the swashplate is varied by setting the drive housing pressure $p_C$ acting on the rear sides of the pistons. For this purpose, the cavity of the drive housing is connected via two control lines, on the one hand, to a conveying chamber (with a conveying pressure $P_D$) of the refrigerant compressor and, on the other hand, to a suction intake chamber (with a suction pressure $P_S$) of the refrigerant compressor. The latter lines are controllable via a control valve of the refrigerant compressor. In this case, the control valve has a control body which acts on both control lines and which is driven electromagnetically, so that, via an associated control, for example a magnetic force acting counter to a spring force can be set and, via said magnetic force, a control position of the control body can be set.

In the control valve and/or refrigerant compressor, in this case, both the conveying-side and the suction-side control line can be throttled or can be shut off in a controlled manner. As a result, while the compressor is in operation, the suction-side control line can be closed or highly throttled, so that the bypass stream of conventional control valves and refrigerant compressors, which is discharged from the drive housing to the suction chamber on the invariably throttled suction-side control line, is greatly reduced or is avoided in order to improve the refrigerating capacity.

Since an activation of a control state shutting off the suction-side control line (in particular, a control state that throttles the latter in a directed manner) can be controlled only with difficulty by means of a solely electromagnetically driven control body, (especially in the absence of detected state variables of the refrigerant circuit), the present control valve or the refrigerant compressor has a control body which is driven by means of a pressure cell. A pressure cell of this type makes it possible to drive the control body as a function of pressure variables or pressure differences occurring on the refrigerant compressor or on the refrigerant circuit, so that specific operating pressure states of the refrigerant compressor can directly influence the activation of the control body. Since electromagnetic activation of the control body is regulated as a function of the existing measurement points of the associated control (for example, even as a function only of secondary measurement variables, such as an evaporator outflow temperature), the pressure cell makes it possible to improve the control valve by taking into account direct state variables on the refrigerant compressor.

In one embodiment of the control valve, a pressure cell for driving the control body is provided, which monitors the pressure difference of the atmospheric pressure $p_A$ of the vehicle surroundings and the suction pressure $p_S$. As a result, as a function of a desired suction pressure, the control body can be activated to open alternately the conveying-side control line (to reduce the conveying capacity in the case of too low a suction pressure) and the suction-side control line (to increase the conveying capacity of the refrigerant compressor in the case of too high a suction pressure). By direct detection of the suction pressure of the refrigerating system and activation of the refrigerant compressor as a function of the suction pressure refrigerating capacity losses and fluctuations (which may occur, for example, in the case of a control dependent on the evaporator temperature) are avoided.

For particularly effective activation of the control body controlling the two control lines, in one embodiment of the control valve and/or of the refrigerant compressor, magnetic action of the magnet coil controlling the control body is converted directly on the control body or on an armature fastened to the control body. As a result, the force of the electromagnetic action of the coil can act directly on the control body of the control valve and, in the case of given force/displacement conditions on the control body, can particularly advantageously be taken into account as a control variable component, for example for the throttling control of an associated port. This is advantageous particularly in the case of a combined activation of the control body with the aid of various force-applying elements, such as, for example, springs or pressure cells. In this case, via the activation of the electromagnetic coil, action can be taken on the force equilibrium on the control body between resilient elements, a pressure transducer or pressure cell and magnetic action. A different operating point of the control valve (that is, a variable desired suction pressure), can thereby be set, so that, once again, a variable basic refrigerating capacity of the compressor can be controlled.

In one embodiment of the control valve or of the refrigerant compressor according to the invention, in the case of an undisturbed operation and state of the associated refrigerating system, when the operation of the refrigerating system is switched off, the control body can assume a position of rest in which the suction-side control line is shut off. This may be achieved by means of a corresponding coordination of the involved spring or drive and switch elements, the control valve and the associated control preferably being dead in this state. By shutting off the suction-side control line of the control valve, settling of refrigerant condensate in the drive housing of the refrigerant compressor is reduced or avoided while the refrigerating system is at a standstill. Thus, when the refrigerant compressor is started again after a lengthy standstill of the refrigerating system, improved starting refrigerating capacity is achieved.

In another embodiment of the control valve, when the suction pressure falls below an associated minimum operating value, the pressure cell brings the control body into a position that releases the conveying-side control line. As a result, for example in the case of leaks of the refrigerant circuit, no damage to the refrigerant compressor is caused by a readjustment of the refrigerating capacity control if the swashplate is set at too high an angle of incidence. Instead, by releasing the conveying-side control line, the swashplate is brought into a neutral position and damage is thereby avoided.

In still another embodiment of the control valve and/or of the compressor according to the invention, the control body, in a control position, can shut off both control lines simultaneously. Thus, in addition to a control operating state releasing the conveying-side control line (and therefore lowering the conveying capacity), and also in addition to a control operation releasing the suction-side control line (and thus increasing the conveying capacity) of the refrigerant compressor, a holding operating state can also be activated. In the latter state, both the suction-side and the conveying-side control line are shut off, and therefore the set conveying capacity can be held without further control actions and without a refrigerant bypass stream, lowering the conveying capacity, via the control lines. Starting from the control state with control lines closed on both sides, for example, a holding operating state can also be activated, in which, with the conveying-side control line closed, a highly throttled suction-side control line is opened, which then does not discharge a bypass stream of the controlled conveying-side control line, but, instead, merely compensates the compression leakages occurring at the pistons.

In order to ensure particularly simple activation and functionally reliable operation of the control valve and/or of the refrigerant compressor, in one embodiment of the control valve or of the compressor the control body can be movable through an intermediate position between two end positions. In a first end position the conveying-side control line is shut off, while in the intermediate position both control lines are shut off, and in a second end position the suction-side control line is shut off. It is thus possible to provide a basic operating position in which both control lines are shut off both on the conveying side and on the suction side (or, with the conveying-side control line shut off, the suction-side control line is highly throttled), and from which the two oppositely effective control actions, (that is, for increasing and lowering the conveying capacity of the refrigerant compressor, respectively) can be activated, from the basic operating position of the control body, in movements contradirectional to one another. This makes it unnecessary, for example, to run over a contradirectional control state in order to activate a desired control state from the basic operating position.

DETAILED DESCRIPTION OF THE DRAWINGS

Figure 1:
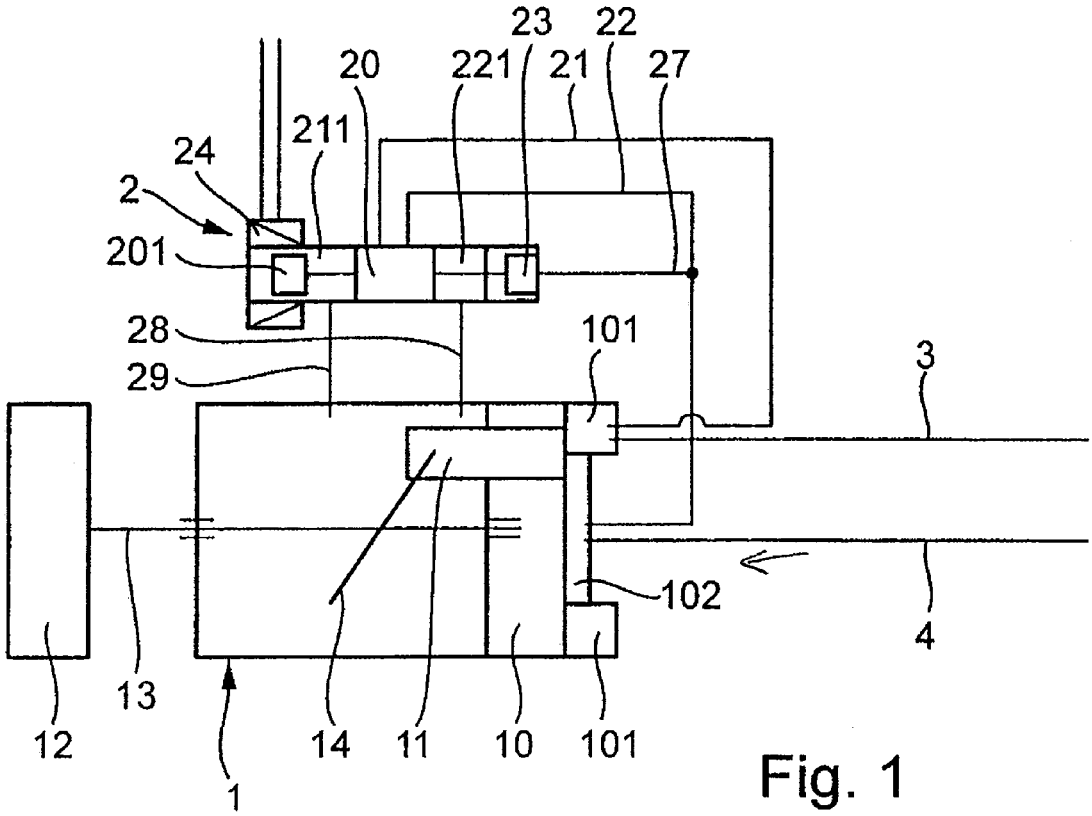
FIG. 1 is a diagrammatic illustration of a refrigerant compressor with an associated control valve according to the invention.

FIG. 1 shows a refrigerant compressor of a motor vehicle 1, which is driven via a belt pulley 12 incorporated in the belt drive of the engine of the motor vehicle. The drive power is transmitted via the belt pulley 12 and a driveshaft 13, (which is arranged, sealed, in a hermetically closed drive housing 10 of the refrigerant compressor 1) transmit drive power to a swashplate 14 which is rotationally fixedly connected to the driveshaft 13. In the drive housing 10, pistons 11 which are engaged with the swashplate 14, execute an alternating stroke movement in an associated cylinder. (Of the several pistons 11 distributed on the circumference, only one is illustrated in the drawing.) The rotating swashplate 14 in this case causes the pistons 11 to be driven in a stroke movement.

Although the dead center terminating the displacement movement of the pistons occurs in an invariable position of the piston, the opposite dead center of the stroke movement of the pistons, which terminates the suction intake movement being determined by a force equilibrium between the pressure $p_C$, which prevails in the drive housing and acts on the rear side opposite the conveying side of the pistons 11, and the pressure acting on the conveying side during the suction intake movement. Thus, by varying the pressure $p_C$ prevailing in the cavity of the drive housing 10, it is possible to vary the swashplate 14 between an angle of incidence of maximum conveying capacity, in the case of a very low drive housing pressure $p_C$, down to an angle of incidence which places the swashplate completely flat and reduces the conveying capacity to zero.

Due to the stroke movement of the pistons 11, the refrigerant compressor 1 conveys refrigerant, sucked in on the suction line 4 of the refrigerant circuit, with a then increased pressure to the delivery line 3 of the refrigerant circuit. The suction line 4 is connected to the suction chamber 102 of the refrigerant compressor 1, out of which the pistons 11 suck in refrigerant, while the delivery line 3 of the refrigerant circuit is connected to the conveying chamber 101, into which the pistons 11 convey the compressed refrigerant. The conveying pistons 11 of the refrigerant compressor are connected to the suction chamber 102, on the one hand, and to the conveying chamber 101, on the other hand, via two nonreturn valves determining the conveying direction and alternately shutting off.

The conveying capacity of the refrigerant compressor 1 is set during conveying operation via the pressure $p_C$ prevailing in the drive housing 10, via a control valve 2 which sets the pressure $p_C$ via the control of two control lines 21 and 22. The conveying-side control line 21 is connected to the conveying chamber 101 with conveying pressure $p_C$, and the suction-side control line 22 is connected to the suction chamber 102 with suction pressure $p_S$. With the control lines being opened correspondingly by means of the control body 20, the control line 21 is connected to the cavity of the drive housing 10 via the control chamber 211 and the supply portion 29. With the suction-side control line 22 being opened, this is connected to the cavity of the drive housing 10 via the associated control chamber 221 and the supply portion 28.

For controlled opening of the two control lines 21 and 22, the control valve 2 has a control body 20. During movement in the control bore, in the two end positions of the control valve 2 which limit the stroke movement of the control body 20, the latter opens the control lines 21 and 22 alternately while in an intermediate position between the end positions, it closes the two control lines 21 and 22. In each case it seals off the control lines with respect to the associated control chamber.

The control body 20 of the control valve 2 is driven in the control bore of the control valve 2 by a magnet coil 24, which acts on the armature 201 of the control body 20 and, on the other hand, by a resiliently flexible pressure cell 23 acted upon in the inner space by suction pressure $p_S$. Thus, starting from a set conveying capacity of the refrigerant compressor 1, an increase of the current flowing through the coil 24 (which increases the associated magnetic force), causes a movement of the control body 20 in the direction of a release of the suction-side control line 22 which is connected to the suction chamber 102 having the suction pressure $p_S$. Consequently, the control line 22 is released with respect to the control chamber 221 of the control valve 2 and can reduce the drive housing pressure $p_C$ via the supply portion 28 of the control line. As a result, in the suction intake state of the conveying pistons 11, the latter are moved out to an increased extent so that an increased refrigerant quantity can be sucked in and conveyed. The conveying capacity of the refrigerant compressor 1 is thus increased.

The same effect as an increase in the current flowing through the coil 24 can be achieved by a variation of the suction pressure $p_S$ in the suction chamber 102 in which the pressure $p_S$ rises. The pressure cell 23 of the control valve 2, which pressure cell is connected to the control body 20 via a pushrod, is connected with its inner space, via a supply line 27, to the suction chamber 102, having the suction pressure $p_S$, of the refrigerant compressor. When the suction pressure $p_S$ rises, the control body moves in the direction of an opening of the suction-side control line in the same way as during the increase in the current flowing through the coil 24, increasing the conveying capacity of the refrigerant compressor, which in turn lowers the suction pressure $p_S$ in the suction chamber 102.

A reduction in the current flowing through the magnet coil 24 and a lowering of the suction pressure $p_S$ in the suction chamber 102 of the refrigerant compressor both bring about a codirectional movement of the control body 20 of the control valve 2 of the refrigerant compressor. Starting from a control state of the control valve in which the two control lines 21 and 22 are shut off, the control body 20 is moved in the direction of an opening of the conveying-side control line 21. By lowering the suction pressure $p_S$ and a resulting contraction of the pressure cell 23, and/or by a reduction in the current of the control coil 24 of the control valve 2, the control line 21 connected to the conveying chamber 101 having the conveying pressure $p_D$ is thus opened. Thus, so that the drive housing pressure $p_C$ in the drive housing 10 of the refrigerant compressor 1 is increased via the control chamber 211 of the control valve 2 and the supply line 29 of the control line. A lower refrigerant quantity is thereby sucked in, so that the suction pressure $P_S$ of the refrigerant compressor is increased.

When the refrigerant system is switched off, the current at the magnet coil 24 is also switched off, so that, with the aid of the resilient action of the pressure cell 23 and of an additional spring possibly present, the control body 20 is moved into a position releasing the conveying-side control line 21 and shutting off the suction-side control line 22. As a result, if the vehicle is stopped for a lengthy period of time, the formation of refrigerant condensate in the drive housing of the refrigerant compressor is prevented by shutting off the suction-side control line 22. A nonreturn valve (not shown in the illustration) is usually provided in the conveying-side control line 21.

When the refrigerant system is in operation, alternating operating states may occur in the refrigerating circuit, for example due to varied ventilation temperatures on the evaporator. As a result, the present coupled control of the control body by means of the pressure cell, on the one hand, and the magnet coil, on the other hand, can be operated with low oscillation and in an easily controllable way.

In the case of a constant excitation of the magnet coil 24, therefore, a desired suction pressure can be set via the pressure cell 23 additionally coupled to the control body 20. If the suction pressure $p_S$ rises, for example due to a higher thermal load on the evaporator in the refrigerant circuit, the pressure cell 23 brings the control body 20 into a control position that releases the suction-side control line 22. Consequently, the drive housing pressure $p_C$ is reduced, and the angle of incidence of the swashplate 14 and therefore the conveying capacity of the compressor are increased, in order to compensate the increased thermal load. Due to the increased conveying capacity, in turn, the suction pressure $p_S$ falls, until the level of the desired suction pressure is reached and the suction-side control line 22 is closed again via the pressure cell 23 acting on the control body 20. With a reduction in the suction pressure $p_S$, an exactly inverse type of action takes place due to the release of the conveying-side control line 21 brought about by the pressure cell 23.

The control loop of the proposed control valve 2 or refrigerant compressor 1 is small and is therefore particularly stable, so that hunting of the refrigerating circuit is prevented on the control body 20 by means of the control action of the pressure cell 23 which readjusts the suction pressure. Changing thermal and drive-induced loads on the refrigerating circuit are detected immediately and readjusted. A basic refrigerating capacity can be set from outside on the control valve 2 via the excitation of the magnet coil 24 which is variable advantageously in a highly damped way.

Figure 2:
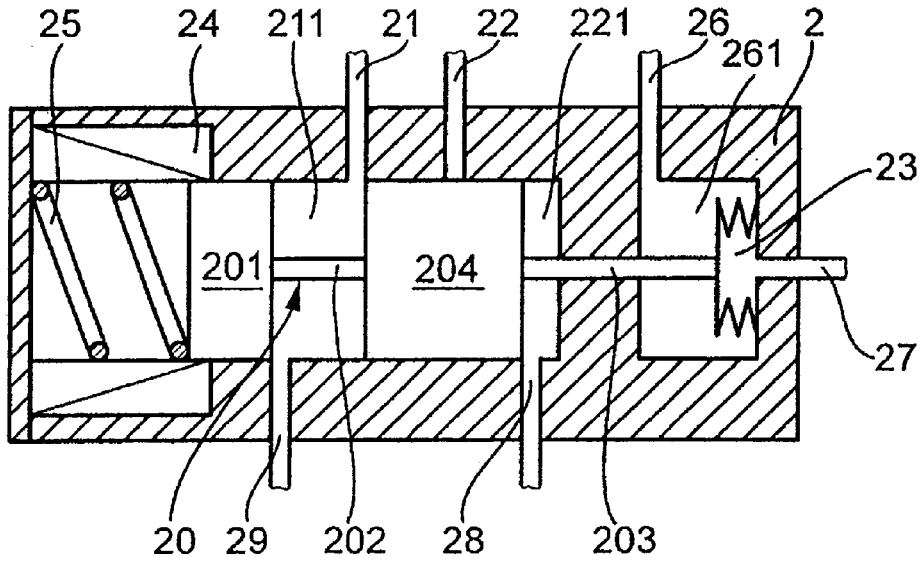
FIG. 2 shows the control valve in the control position in which it is open on the conveying side.
Figure 3:
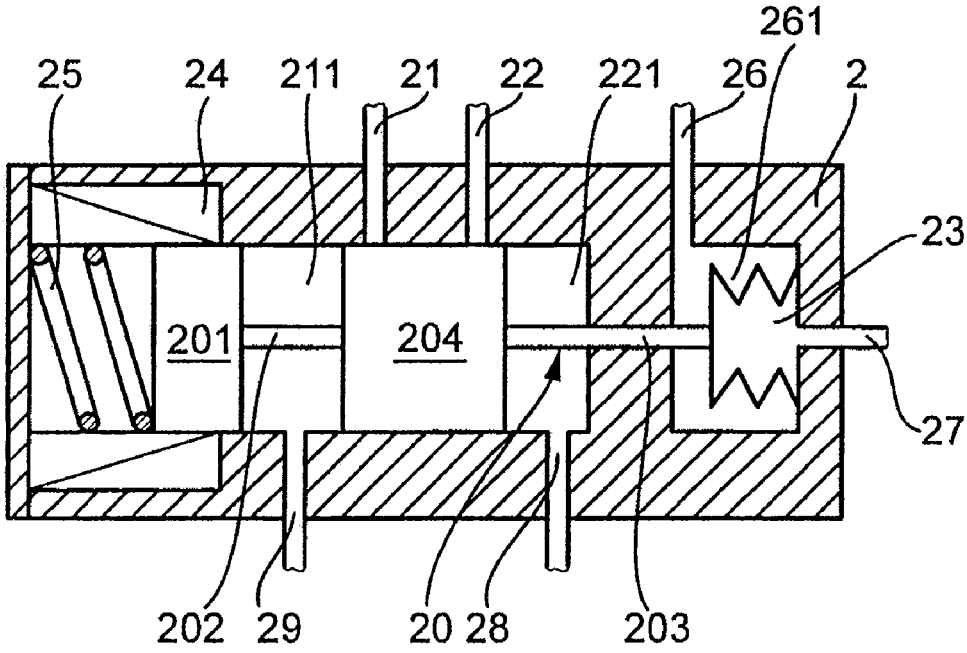
FIG. 3 shows the control valve in a control position with a control line closed on both sides.
Figure 4:
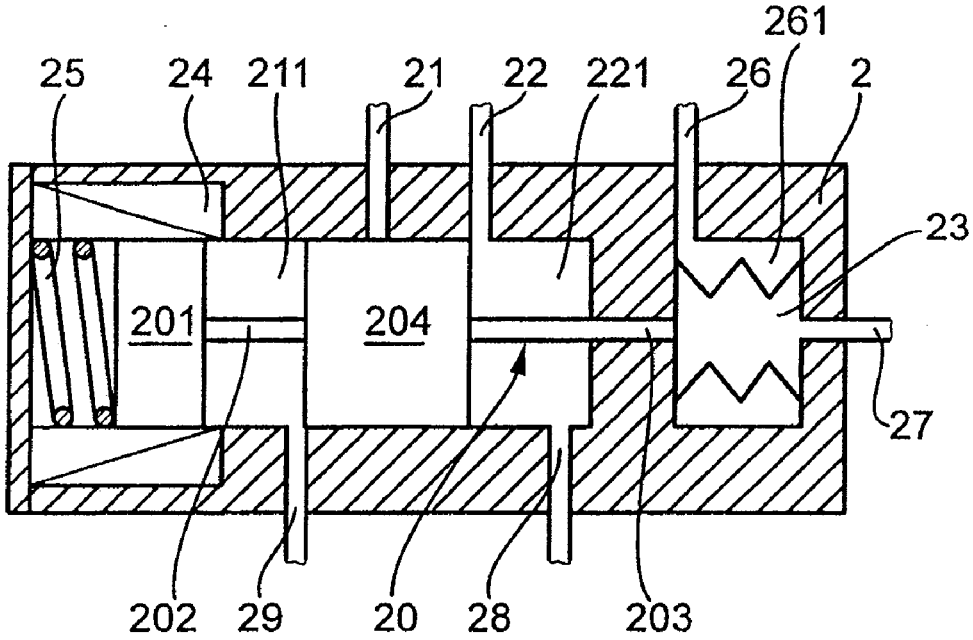
FIG. 4 shows a control valve with a control line released on the suction side.

FIGS. 2 to 4 are schematic illustration of an embodiment of the control valve 2 of a refrigerant compressor 1 of a motor vehicle in various control positions. The control valve is in all instances identical in terms of the components and their control-independent arrangement, so that descriptions of corresponding articles and situations in individual figures apply likewise to the other figures.

The control valve 2 illustrated in FIG. 2 has in a housing a control body 20 which is arranged movably with its cylindrical cross section within a corresponding cylindrical control bore of the control valve 2. The control body 20 in this case has part bodies of different diameters. The control bore of the control valve 2 has connected to it, on the one hand, a control line 21 connected to the conveying side having the conveying pressure $p_D$, a control line 22 connected to the suction side having the suction pressure $p_S$ and the supply portions 28 and 29 of the control lines to the drive housing of the refrigerant compressor. The central shut-off body of the control body 20 bears completely continuously and sealingly against the outer wall of the cylindrical control bore, so that it divides the latter into a conveying-side control space 211 and a suction-side control space 221. These are connected in each case to the associated control line portions 28 and 29 connected on the drive housing side.

Alternatively, the control body 20 may also be divided into two shut-off bodies which lie next to one another in the axial direction and which are connected by means of a pushrod narrowed in the radial direction with respect to the two shut-off bodies, the pushrod releasing a central control chamber which is delimited laterally by the shut-off bodies. The shut-off bodies alternately release the two control lines with respect to the central control chamber which is connected to the cavity of the drive housing via a supply portion.

Arranged internally on the valve housing, in the region of the control bore, is an electromagnetically operable control coil 24, which acts magnetically on an assigned armature 201 of the control body 20. The control body 201 is arranged at the middle orifice of the coil 24 so as essentially to fill the control bore in the radial direction. The armature 201 is connected to the central control body via a region of the control body 20, said region being reduced radially as an armature connecting rod 202 and keeping the control chamber 211 there free. Located in the inner orifice of the coil 24 is a helical spring 25 which supports the control body 20 counter to the magnetic attraction direction. An excitation of the coil 24 generates a magnetic action that attracts the armature 201 of the control body 20, so that the latter is moved with its central shut-off body in the direction of the conveying-side control line 21 by the current in the coil 24 being increased.

On the side lying opposite the armature, the control body 20 has a region which, again, is reduced in the radial direction as a connecting rod 203 and which leads, sealed, through an associated bore of the housing of the control valve as far as a pressure cell chamber 261 and is connected to a pressure cell 23. The pressure cell chamber 261 is connected via a supply line 26 to the vehicle surroundings having atmospheric pressure. In the pressure cell chamber 261, the resiliently designed pressure cell 23 is arranged, which is designed to be hermetically leaktight with its inner space with respect to the pressure cell chamber and which is connected with its inner space, via the supply line 27, to the suction side, having the suction pressure $p_S$, of the refrigerant compressor. A rise in the suction pressure $p_S$ therefore causes a displacement of the shut-off body of the control body 20 in the direction of the conveying-side control line 21. A reduction in the suction pressure $p_S$ causes an opposite movement of the control body 20 in the direction of the suction-side control line 22.

FIG. 2 shows a control state of the control valve 2 in which the central shut-off body 20 connects the conveying-side control line 21 via the conveying-side control chamber 211 to the control line portion 29 connected to the drive housing of the compressor. The central shut-off body of the control body 20 in this case shuts off the suction-side control line 22 with respect to the drive housing of the compressor. This control position is assumed, in particular, in two operating situations of the refrigerant compressor. On the one hand, this is the situation with the refrigerating system switched off (that is, in an operating state of rest) and, on the other hand, the situation is the same when a reduction in the conveying capacity of the refrigerant compressor is activated.

In the first instance, the currentless coil 24 of the control valve 2 has the effect that, at this point, no force on the control body 20 moving the control body 20 in the direction of the conveying-side control line 21 is introduced. In this case, the resilient action of the pressure cell 23 or, in the present instance, assisted by the spring 25, causes, counter to the suction pressure of rest prevailing in the pressure cell 23 on the suction side of the refrigerant circuit, the control position, shown, of the control body 20 in the control valve 2 to be assumed. In this case, the conveying-side control line 21 is connected to the drive housing of the refrigerant compressor via the control chamber 211 and the control line portion 29. This has the effect, with the refrigerating machine running down, of setting the swashplate at an angle of incidence in the direction of a minimum conveying capacity, that is to say in the direction of a neutral position, with the result that the drag moment in off operation and during the restarting of the engine is reduced. The suction-side control line is sealingly closed with respect to the drive housing of the compressor by means of the central shut-off body of the control body 20, so that, with the refrigerating circuit being at rest for a lengthy period of time, penetration of condensing refrigerant via the open suction-side control line is avoided.

In the second operating situation (FIG. 2), in which the control position, of the control body 20 in the control valve 2 is assumed, the control valve 2 is in a control state in which the refrigerant conveying capacity of the refrigerant compressor 1 is reduced. In general (that is, also in other control operating states), a basic capacity of the refrigerant compressor is set on the control valve 2 via the coil 24 by the excitation of the coil. The control body 20 is thereby moved first in the direction of the conveying-side control line 21. The conveying activity of the refrigerant compressor in this case reduces the suction pressure $p_S$. If, then, the conveying capacity becomes too high in the region of the basic conveying capacity of the refrigerant compressor predetermined by the control of the air-conditioning system via the coil 24, the suction pressure $p_S$ on the suction intake side of the compressor falls, and reduces the pressure in the pressure cell 23 via the supply line 27 connected to the suction side. As a result, the control body 20 is moved toward the suction-side control line 22 via the connecting rod 203, so that, with the suction-side control line 22 shut off, the conveying-side control line 21 is released. The drive housing of the refrigerant compressor is thus acted upon by pressure increased above the conveying-side pressure $p_D$, so that the pressure $p_C$ in the drive housing of the refrigerant compressor rises and the swashplate is set at a flatter angle of incidence which reduces the refrigerant conveying capacity.

As shown in FIG. 3, the control position of the control valve 2 may likewise be provided as a position of rest of the control valve, in a manner similar to the control position shown in FIG. 2. In this instance both the conveying-side control line 21 and the suction-side control line 22 are shut off.

Otherwise, as illustrated in FIG. 3, the control position of the control valve 2 is assumed, if the conveying capacity of the refrigerant compressor coincides with the basic conveying capacity provided by the control of the refrigerating system. In this case, the force of the suction pressure $p_S$ in the pressure cell 23 (which is codirectional with the magnetic force of the coil 24) causes the control body 20 in the control bore of the control valve 2 to assume the position as shown. In this case, both the conveying-side control line 21 and the suction-side control line 22 are shut off with respect to the associated control chambers 211 and 221 or with respect to the control line portions 28 and 29 connected to them and connected to the drive housing 10 of the refrigerant compressor 1. The codirectional forces of the magnetic action of the coil 24 on the armature 201 and of the suction pressure $p_S$ acting in the pressure cell 23 with respect to the atmospheric pressure prevailing in the pressure cell chamber 261 are, in the control state (shown) of the control valve 2, in equilibrium with the spring forces necessary for corresponding deformation of the pressure cell 23 or with an additional spring force required for the deformation of the helical spring 25.

FIG. 4 shows a control state of the control valve 2 which causes an increase in the conveying capacity of the refrigerant compressor (for example, by means of an increase in the requirement for the basic refrigerating capacity via the control of the refrigerating circuit), activated via an increased current at the coil 24, or, in the case of a basic refrigerating capacity activated, unchanged, acts on the pressure cell 23 via an increased suction pressure $p_S$ prevailing on the refrigerant compressor. By means of the increased suction pressure $p_S$ acting on the pressure cell 23 and/or the increased magnetic force acting on the armature 201 of the control body 20, the control body 20 is displaced counter to the spring forces of the pressure cell 23 and, if appropriate, to an additional spring 25 in the direction of the conveying-side control line 21. As a result, the shut-off body of the control body 20 sealingly shuts off the conveying-side control line 21 with respect to the associated control chamber 211 and to the control line portion 29 located there and connected to the drive housing of the refrigerant compressor. In this case, the suction-side control line 22 is opened with respect to the associated control chamber 221, so that the drive housing pressure $p_C$ in the drive housing of the refrigerant compressor is reduced via the control line portion 28 connected to the control chamber 221. As a result, a setting of the swashplate at a higher angle of incidence and therefore an increase in the conveying capacity of the refrigerant compressor take place.

The control positions of the control valve 2 which are illustrated in FIGS. 2 to 4 may be assumed alternately, as a result of different actions, while the refrigerant compressor is in operation. With the suction pressure acting on the pressure cell 23 remaining the same, a displacement of the control body 20 is brought about in the direction of a shut-off of the conveying-side control line in the case of a rise in the current of the coil 24 and in the direction of a shut-off of the suction-side control line in the case of a reduction in the current of the coil 24.

On the other hand, a displacement of the control body 20 in the control valve 2 takes place by means of a varied suction pressure $P_S$ which moves the control body 20 via the pressure cell 23. A variation of the suction pressure $p_S$ which prevails in the inner space of the pressure cell 23 and/or of the magnetic force of the coil 24 on the armature 201, varies the force equilibrium of the magnetic force, spring forces of the helical spring 25 and pressure cell 23 and also pressure cell force due to the differential pressures prevailing there. As a result of such a variation, a varied position of the shut-off body 204 of the control body 20 is brought about, up to the setting of a new force equilibrium.

The control action on the control valve 2 which accompanies the variation in position causes a variation in the refrigerating capacity of the refrigerant compressor and consequently a suction pressure variation which, via the pressure cell, has an action counteracting the control action and therefore bringing the control body 20 once again into the holding control position. Thus, an increase of the suction pressure $p_S$ in the pressure cell achieves a displacement of the shut-off body in the direction of a release of the suction-side conveying line 22 via the pushrod 203, so that, due to the accompanying reduction of the drive housing pressure $p_C$ in the refrigerant compressor, an increase in the conveying capacity of the refrigerant compressor takes place.

The suction pressure $p_S$ thus falls again, with an associated lowering of the pressure force of the pressure cell, causing a shut-off of the suction-side control line 22. There is therefore no further increase in the conveying capacity of the refrigerant compressor. A reduction in the suction pressure $p_S$ causes a contradirectional action, so that a reduction in the pressure force of the pressure cell 23 on the control body 20 displaces the shut-off body 204 in the direction of a release of the conveying-side control line 21. Therefore, due to the accompanying increase in the drive housing pressure $p_C$, the refrigerating capacity is reduced, consequently increasing the suction pressure $p_S$. As a result, in turn, the pressure force of the pressure cell 23 increases, so that the conveying-side control line 21 is closed again.

A corresponding change of the current that flows to the coil 24 causes a change of the magnetic force on the armature 201 of the control body 20. In each case a force equilibrium prevails on the control body 20 between the magnetic force, the spring forces of the helical spring 25 and pressure cell 23 and the different pressures acting on the pressure cell on both sides of its active surface. The forces are in this case transmitted from the armature 201 via the connecting rod 202 to the central shut-off body 204 of the control body 20 and via the pushrod 203 to the front side (having the active surface of the pressure cell 23) of said pressure cell. A change in the magnetic force thus causes the control body to assume the middle holding position, along with a force of the pressure cell 23, varied according to the variation in the magnetic force, and therefore with a suction pressure varied according to the active surface of the latter. Thus, by activating the magnet coil 24, the desired suction pressure at which the holding control position of the control valve 2 is assumed can be varied.

Thus, via an advantageously highly damped excitation of the coil 24 and via the associated magnetic force, a variable operating point of the refrigerant compressor can be set. Via the pressure cell 23, this operating point, in a direct force equilibrium between the magnetic force, involved spring elements and the force of the pressure cell, adjusts an essentially constant suction pressure $p_S$ associated with the operating point set via the magnet coil, or with a varied force equilibrium.

The invention claimed is:

1. A control valve for controlling pumping of a refrigerant compressor by setting a drive housing pressure of the refrigerant compressor, said control valve comprising:

a control body which controls i) a conveying-side control line between a discharge chamber, acted upon by high pressure of the compressor, and a drive housing of the compressor, and ii) a suction-side control line between the drive housing and a suction chamber, acted upon by suction pressure, of the compressor variably in a throttling and/or shutting-off manner; wherein, the control body of the control valve is driven electromagnetically;

the control body can shut off both the conveying-side and the suction-side control line; and the control body is also driven by a pressure cell.

2. The control valve as claimed in claim 1, wherein the pressure cell monitors the pressure difference of the atmospheric pressure $p_A$ of the vehicle surroundings and the suction pressure $p_S$.

3. The control valve as claimed in claim 1, wherein to control the control body, an electrically operated magnet coil acts magnetically on the control body or on an armature fastened to the control body.

4. The control valve as claimed in claim 1, wherein, when the refrigerating system is switched off, in an undisturbed operation and state of the associated refrigerating system, the control valve, in the position of rest, shuts off the suction-side control line.

5. The control valve as claimed in claim 1, wherein, when suction pressure falls below a minimum operating value, the pressure cell brings the control body into a position releasing the conveying-side control line.

6. The control valve as claimed in claim 1, wherein the control body can shut off both control lines simultaneously.

7. The control valve as claimed in claim 1, wherein:

the control body is movable through an intermediate position between two end positions;

in a first end position the conveying-side control line is shut off;

in the intermediate position both control lines are shut off; and in the second end position the suction-side control line is shut off.

8. A refrigerant compressor for the air-conditioning system of a motor vehicle, with a control valve for controlling pumping of the refrigerant compressor by setting a drive housing pressure of the refrigerant compressor; wherein the refrigerant compressor comprises:

a control body which controls i) a conveying-side control line between a discharge chamber, acted upon by high pressure $p_D$ of the compressor, and a drive housing of the compressor, and ii) a suction-side control line between the drive housing and a suction chamber, acted upon by suction pressure of the compressor;

the control body can shut off both the conveying-side and the suction-side control line;

the control body is driven electromagnetically; and the control body is also driven by a pressure cell.

9. The refrigerant compressor as claimed in claim 8, wherein the pressure cell monitors the pressure difference of the atmospheric pressure $p_A$ of the vehicle surroundings and the suction pressure $p_S$.

10. The refrigerant compressor as claimed in claim 8, wherein when the refrigerating system is switched off, in the case of an undisturbed operation and state of the associated refrigerating system, the control valve, in the position of rest, shuts off the suction-side control line.

11. The refrigerant compressor as claimed in claim 8, wherein when suction pressure falls below a minimum operating value, the pressure cell brings the control body into a position releasing the conveying-side control line.

12. A control valve for controlling pumping of a refrigerant compressor, said control valve comprising:

a drive housing;

a discharge chamber;

a conveying side control line between the discharge chamber and the drive housing, said conveying side control line being coupled in communication with a high pressure of the compressor;

a suction chamber;

a suction side control line between the suction chamber and the drive housing, said suction side control line being coupled in fluid communication with a suction pressure of the compressor, in a variable manner; and a control body which controls opening and closing of the conveying side control line and the suction side control line; wherein, the control body is driven electromagnetically; and the control body is also driven by a pressure cell that is coupled to said suction chamber.

* * * * *